US006719341B2

(12) United States Patent
Götz et al.

(10) Patent No.: US 6,719,341 B2
(45) Date of Patent: Apr. 13, 2004

(54) APPARATUS FOR CONTINUOUSLY ADJUSTING THE LENGTH OF A SLINGING MEANS DESIGNED TO CARRY A LOAD

(75) Inventors: Rolf Götz, Übach-Palenberg (DE); Willi Panhausen, Gangelt (DE)

(73) Assignee: SpanSet Inter AG, Oetwil am See (CH)

( * ) Notice: Subject to any disclaimer, the term of this patent is extended or adjusted under 35 U.S.C. 154(b) by 97 days.

(21) Appl. No.: 10/043,019

(22) Filed: Jan. 8, 2002

(65) Prior Publication Data

US 2002/0195830 A1 Dec. 26, 2002

(30) Foreign Application Priority Data

Jan. 10, 2001 (DE) ..... 101 00 992

(51) Int. Cl.[7] ..... B66C 1/12

(52) U.S. Cl. ..... 294/82.11; 294/74; 24/164; 24/191

(58) Field of Search ..... 294/74, 82.1, 82.11; 24/68 CD, 164, 191, 197, 265, 265 CD

(56) References Cited

U.S. PATENT DOCUMENTS

| | | | | | |
|---|---|---|---|---|---|
| 2,265,507 | A | * | 12/1941 | Anderson et al. | 24/191 |
| 3,161,931 | A | * | 12/1964 | Zif | 24/200 |
| 3,449,798 | A | * | 6/1969 | Hofmann | 24/71 R |
| 4,315,350 | A | * | 2/1982 | Looker et al. | 24/68 R |
| 4,525,007 | A | * | 6/1985 | Chapalain | 294/74 |
| 4,799,296 | A | * | 1/1989 | Rasmussen | 24/68 R |
| 5,620,127 | A | * | 4/1997 | MacKenzie | 224/555 |
| 5,651,573 | A | * | 7/1997 | Germain | 294/74 |

FOREIGN PATENT DOCUMENTS

| | | | | |
|---|---|---|---|---|
| DE | 2529467 | * | 1/1977 | 294/74 |
| DE | 3119859 | * | 12/1982 | 294/82.11 |
| DE | 3731061 | * | 4/1989 | 294/82.1 |

* cited by examiner

*Primary Examiner*—Eileen D. Lillis
*Assistant Examiner*—Paul T. Chin
(74) *Attorney, Agent, or Firm*—Proskauer Rose LLP

(57) ABSTRACT

An apparatus for continuously adjusting the length of a lifting sling designed to carry a load comprises a U-shaped clamp having a central region, and first and second side legs projecting from the ends of the central region, a swivel axis member supported by bearings in the first and second legs of the clamp; a load lifting element attached to the clamp which is designed for attachment to a load; and a clamping element supported on the swivel axis member. The clamping element comprises: (i) first and second side legs spaced apart from each other, each side leg having a free end coupled to the swivel axis member and a second end; (ii) an end cross-piece formed at the second end of one of the side legs and spanning the distance between the side legs; and (iii) a center cross-piece located between the end cross-piece and the swivel axis member.

11 Claims, 4 Drawing Sheets

APPARATUS FOR CONTINUOUSLY ADJUSTING THE LENGTH OF A SLINGING MEANS DESIGNED TO CARRY A LOAD

BACKGROUND OF THE INVENTION

The invention relates to an apparatus for continuously adjusting the length of a lifting sling designed to carry a load. Such lifting slings generally comprise flat woven textile slinging means which can be equipped with loops for attaching to the hook of a transport crane.

Lifting slings with loops or in continuous form (belt slings) are known from the old DIN 61360 or the new DIN EN 1492-1. In each case, they serve as slinging means with a precisely defined working length. By equipping these lifting slings with suitable fittings such as D-clamps, they form suspension attachments which can be suspended from a crane hook. Additional forged coupling elements and hooks also can form part of the known suspension attachments.

The known lifting slings are only available in each case in a fixed length predefined by the manufacturer or user. In practice, the length of the lifting slings can only be suitably adapted to the particular transport problem to be overcome by using a high-strength slinging chain whose length can be adjusted using chain shorteners. This makes the handling of known lifting slings complicated and limits the field of application.

The object of the invention is to improve the versatility of lifting slings of the type mentioned above.

SUMMARY OF THE INVENTION

This object is achieved by an apparatus for continuously adjusting the length of a lifting sling designed to carry a load, which comprises a U-shaped clamp having a central region and legs projecting from the central region, each of the legs having a bearing for supporting a swivel axis member, a load-lifting element secured to the clamp to which the load can be attached, and a clamping element supported on the swivel axis, the load-lifting element having:(i) two side legs running parallel to one another and separated from each other by a distance, each side leg having one free end coupled to the swivel axis member, (ii) an end cross-piece formed at the other end of at least one of the side legs which spans the distance between the side legs, and (iii) a center cross-piece arranged between the end cross-piece and the swivel axis member. The swivel axis member, the central part of the U-shaped clamp, the center cross-piece, and the end cross-piece are preferably substantially axially parallel one to another.

An apparatus constructed according to the invention is intended to be attached to the unlooped end of a lifting sling. For this purpose, the apparatus on the one hand has a U-shaped clamp to which the load to be carried is attached. On the other hand, the apparatus according to the invention is provided with a clamping element via which the coupling with the lifting sling is made. This clamping element is designed so that the coupling between the lifting sling and the apparatus is made in a simple fashion and the required length of the lifting sling can be varied just as simply.

Thus, in the load-free state the apparatus according to the invention swivels into a threading-in position in which the lifting sling can be suitably positioned about the cross-pieces of the clamping element and the swivel axis without the action of forces impeding the threading process. Then the apparatus is swivelled into its load-lifting position in which movement of the belt length is prevented by self-locking in the apparatus. At the same time, since the U-shaped clamp coupled to the load is flexibly coupled via a swivel axis to the clamping element forming the coupling to the lifting sling, this ensures that the forces to be absorbed during transport of the load are always introduced into the lifting sling in an optimal fashion. By bringing the apparatus into a position located between the threading-in position and the load-lifting position, this self-locking can be loosened to an extent such that the length of the lifting tool can be adapted to the particular requirements without any problem.

The apparatus according to the invention is thus a connecting element which makes it possible to couple loads of various types and shapes to a single lifting sling in the sense of a modular system. The invention not only allows the length of the lifting sling to be varied arbitrarily, but also allows attachment to the U-shaped clamp of a wide range of connecting elements and hooks which are best suited to the particular transport problem to be overcome.

The advantages of using an apparatus according to the invention especially emerge when intricately shaped loads are to be transported on multi-strand suspension attachments. By coupling each individual strand of such a suspension attachment to the load via an apparatus according to the invention, the length of each strand can be adapted to the required geometry and the center of gravity of the load without any problem, so that the safest possible transport can be ensured even for loads having a non-uniform geometry.

The forming of the U-shaped clamp can be simplified by constructing the elements required to attach the load-lifting element at the central part of the U-shaped clamp. However, it is just as feasible to form suitable elements at the legs of the relevant clamp. With reference to an optimum introduction of the forces to be absorbed into the clamp and the lifting sling coupled to the clamp during transport, it is favorable if the load-lifting element is flexibly supported on the U-shaped clamp.

An embodiment of the apparatus according to the invention which substantially facilitates threading in the lifting sling is characterised by the fact that the first side leg carrying the end cross-piece is longer than the second side leg of the clamping element. In this way, between the end of the end cross-piece and the free end of the second side leg there is a free space through which the lifting sling can be pushed. With reference to the safety of the self-locking under load, it is favorable if the free end of the end cross-piece is arranged facing the end of the second side leg assigned to it and at some distance from this end. This ensures that the lifting sling is supported on the end cross-piece over its entire width. The safety of guiding the belt in the clamping element is further improved by the end cross-piece having at its free end an extension oriented towards the end of the second leg. This extension reliably prevents the belt from sliding out of the clamping element in the load-free state or during adjustment of the length. The same purpose is served if the second side leg has its end assigned to the end cross-piece projecting above the position at which it is connected to the center cross-piece. The section projecting above the end cross-piece prevents the belt from slipping from the centre cross-piece.

The components of an apparatus according to the invention can be manufactured particularly economically by forging.

BRIEF DESCRIPTION OF THE DRAWINGS

Further advantages of the invention are explained in greater detail in connection with the embodiment depicted in the drawings, where.

DETAILED DESCRIPTION OF THE INVENTION

Figure 1:
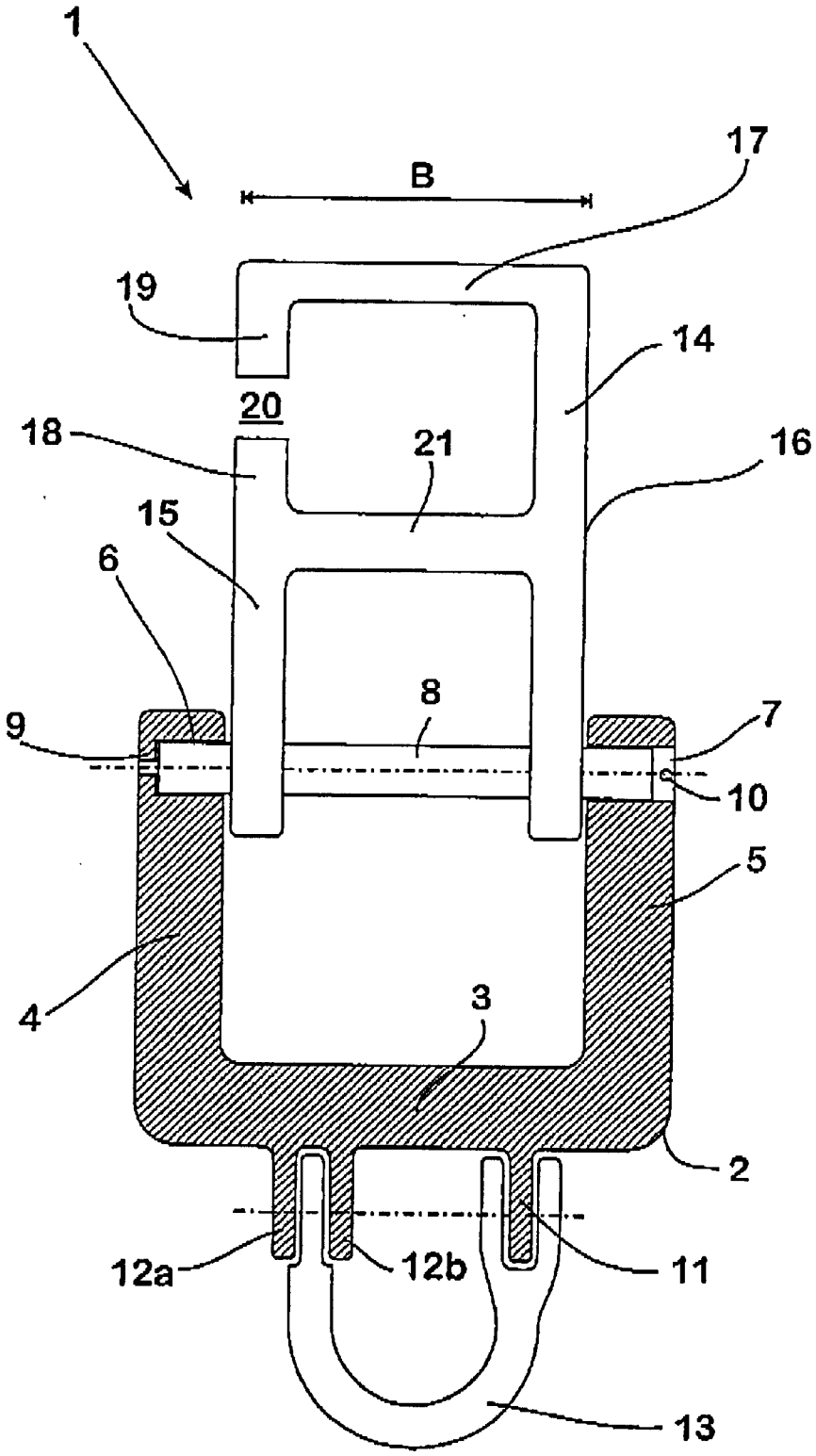
FIG. 1 is a front view of the inventive apparatus for adjusting the length of a lifting sling carrying a load.

Referring to the drawings, the apparatus 1 is intended for adjusting the length of a lifting sling H and for coupling a load F to the lifting sling H. Said apparatus has a U-shaped clamp 2 forged from a metal material, which has a web-shaped central part 3. Legs 4, 5 are formed on each end of the central part 3 at right angles therefrom.

The legs 4, 5 have the same lengths. At their free ends, bearings 6, 7 are provided to support a swivel axis member 8 running substantially parallel to the central part 3. The bearing 6 assigned to the one leg 4 has a stop 9 at its outer side facing away from the leg 5, whereas the bearing 7 of the other leg 5 is constructed as a through opening. For assembly, the swivel axis member 8 is pushed through the bearing 7 until its one end locates in the opposite bearing 6. A safety element 10, constructed as a splint, is then pushed into a side opening of the bearing 7 provided for this purpose, so that the swivel axis member 8 is secured against falling out from the bearings 6, 7 as a result of excessive axial displacement.

On its side facing the swivel axis member 8 shoulders 11, 12*a,* and 12*b* are formed on the central part 3 on which, for example, an arc-shaped load-lifting element 13 designed to accommodate the load F can be flexibly supported. The shoulders 12*a,* 12*b* are arranged so close together that one end of the load-lifting element 13 is held in them, such that this end is secure against displacement in the axial direction. For the same purpose, the other end of the load-lifting element 13 assigned to the shoulder 11 is designed as a fork shape to receive the shoulder 11. Depending on the particular transport problem to be overcome, hooks or other load-lifting elements (not shown) can be attached to the shoulders 11, 12*a,* and 12*b*.

The free ends of the side legs 14, 15 of a clamping element 16, also forged from metal material, are supported by the swivel axis member 8 using bearings not shown in detail. The width B of this clamping element 16 is dimensioned such that the side legs 14, 15 extend between the legs 4, 5 of the U-shaped clamp 2.

The side legs 14, 15 essentially extend parallel to one another and at right angles to the swivel axis member 8. The side leg 14 is approximately a third longer than the side leg 15. At its free end, the first leg 14 has an arm-shaped end cross-piece 17 positioned at right angles therefrom and extending axially parallel to the swivel axis member 8 over the width B of the clamping element 16. At its free end positioned opposite the free end section 18 of the second side leg 15, the end cross-piece 17 has an extension 19 oriented in the direction of the second side leg, so that a guide slot 20 is formed between the end of the extension 19 and the end section 18.

A center cross-piece 21 extends between the side legs 14, 15 approximately at the center between the swivel axis member 8 and the end cross-piece 17, and substantially axially parallel thereto. The length of the second side leg 15 is such that its end section 18 projects freely above the junction point between the side leg 15 and the center cross-piece 21.

Figure 2:
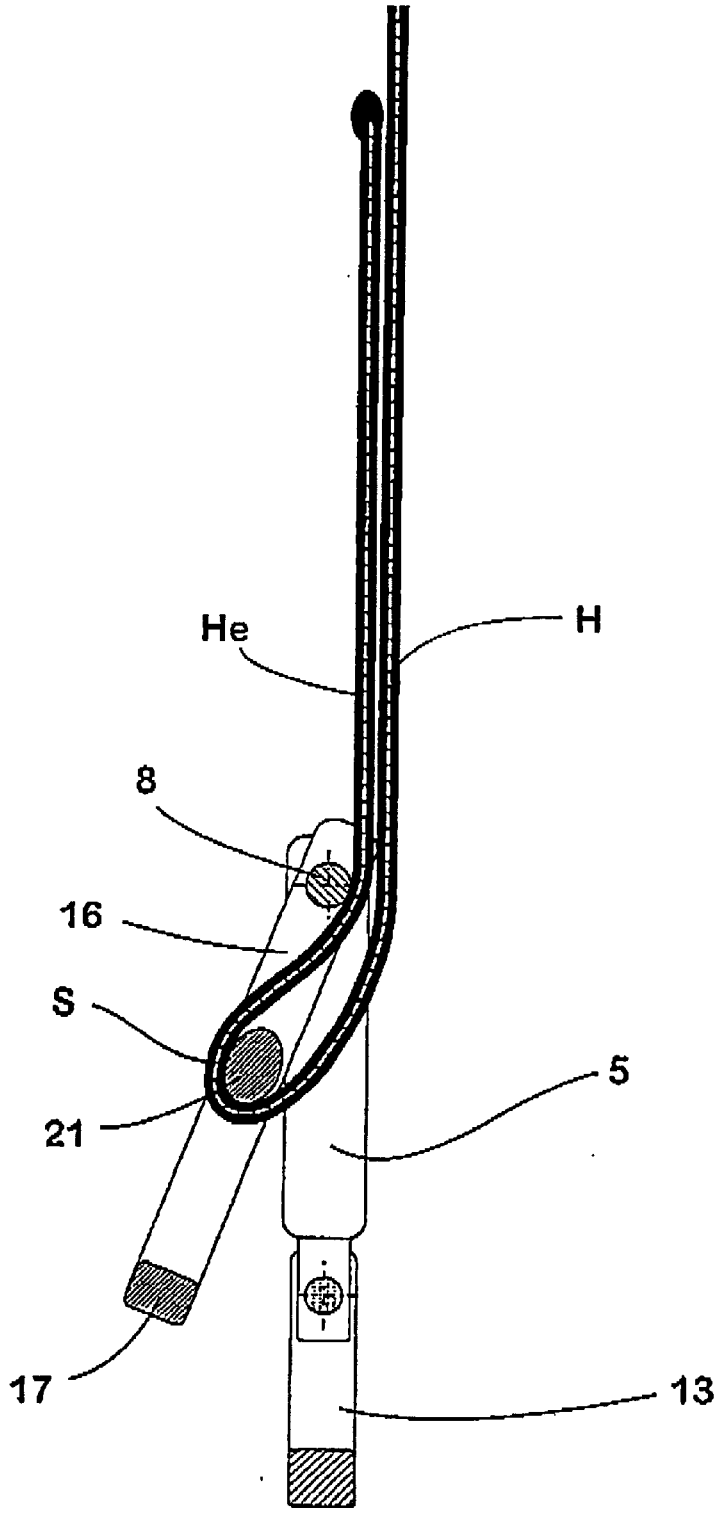
FIGS. 2 to 4 are side views of a suspension attachment constructed from a lifting sling and an apparatus according to FIG. 1 in various operating positions.

Referring to FIG. 2, in order to thread into the apparatus 1 an unlooped end section He of the lifting sling H suspended vertically downwards from a crane (not shown), the clamping element 16 is swivelled anticlockwise about the swivel axis member 8 in the direction of the load-lifting element 13 until an acute angle of approximately 20° is enclosed between the clamp 2 and the clamping element 16. The end section He of the lifting sling H is then placed around the center cross-piece 21 from the side facing away from the clamping element 16 and guided back to that side of the swivel axis member 8 assigned to the section of the lifting sling H leading to the crane. In this way, the end section He becomes positioned between the lifting sling H and the swivel axis member 8, and a loop S is formed around the center cross-piece 21 (see FIG. 2).

Figure 3:
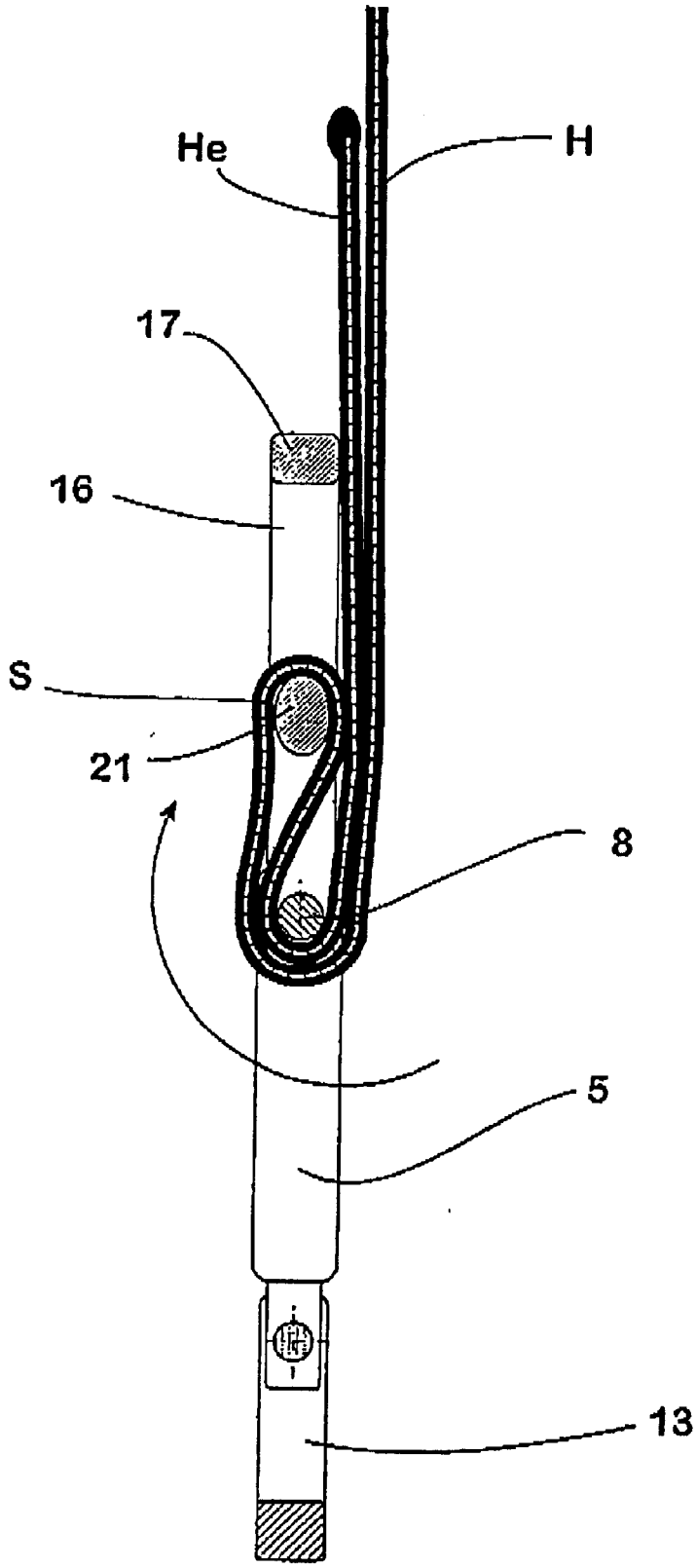

The clamping element 16 is then swivelled back in the clockwise direction into its initial position in which it is aligned essentially in line with the clamp 2. With this swivelling movement, the loop S is drawn upwards so that the swivel axis member 8 is surrounded around more than 180° by the end section He and the section of the lifting sling H leading to the crane. Three layers of the lifting sling, namely, the loop S, the end section He, and the section of the lifting sling H leading to the crane lie simultaneously on the side of the center cross-piece 21 assigned to the lifting sling H (see FIG. 3).

Figure 4:
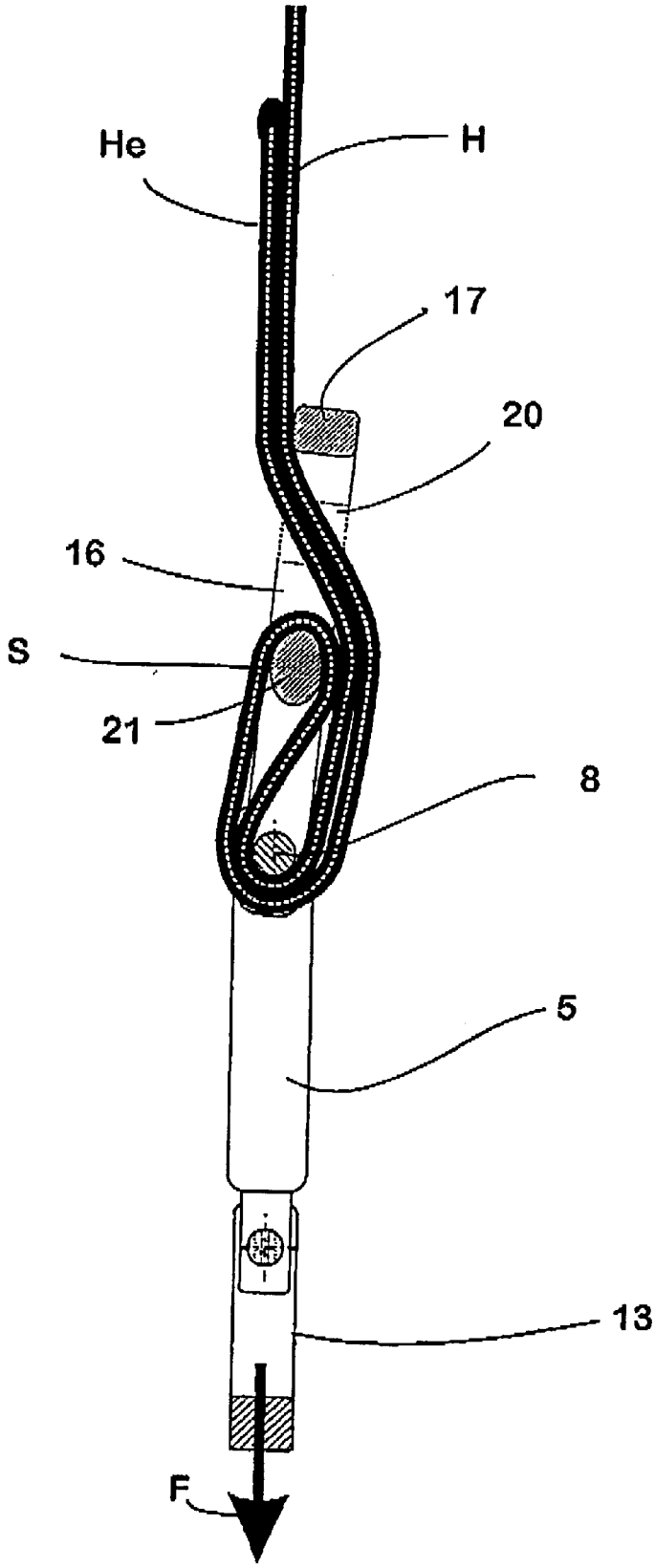

Finally, the end section He and the section of the lifting sling H leading to the crane are threaded through the guide slot 20 so that the side facing away from the end section He of the section of the lifting sling H leading to the crane lies on the end cross-piece 17. When the load F is applied, this results in self-locking of the sling in the apparatus 1 (see FIG. 4).

By swivelling the clamping element 16 anticlockwise again, the self-locking can be released so that the length of the lifting sling H can be adapted to the particular transport problem.

For coupling with the crane, the lifting sling H can have a simple loop, not shown here, constructed by sewing. Likewise, a D-shaped clamp (not shown here) can be connected to the lifting sling H via a suitable loop. Likewise, several lifting slings H can be attached jointly via a single ring to a crane or another transport, lifting or holding apparatus.

A suspension attachment for transporting goods having a non-uniform external shape can be equipped with several lifting slings H arranged along the goods to be transported. By using the apparatus 1, it is possible to adapt their lengths individually to the outside diameter at the respective points of attachment.

REFERENCE SYMBOLS

F Load
B width of clamping element 16
H lifting sling
He end section He of lifting sling H
1 apparatus for adjusting the length of a lifting sling H
2 U-shaped clamp
3 central part of U-shaped clamp 2
4,5 Legs of U-shaped clamp 2
6,7 Bearings
8 Swivel axis
9 Stop
10 Safety element
11,12*a*,12*b* Shoulders
13 Load-lifting element
14,15 Side legs
16 Clamping element

17 End cross-piece
18 End section of side leg 15
19 Extension
20 Guide slot
21 Center cross-piece

What is claimed is:

1. An apparatus for continuously adjusting the length of a lifting sling designed to carry a load, comprising a U-shaped clamp having a central region, and first and second legs projecting from ends of the central region, each of said legs having a bearing constructed therein, a swivel axis member supported by said bearings in said first and second legs of said clamp, a load lifting element attached to said clamp, said load lifting element being designed for attachment to a load, a clamping element supported on said swivel axis member, said clamping element comprising: (i) first and second side legs spaced from each other, each side leg having a free end coupled to said swivel axis member and a second end, (ii) an end cross-piece formed at the second end of at least one of said side legs and spanning the distance between said first and second side legs, and (iii) a center cross-piece located between the end cross-piece and the swivel axis member.

2. The apparatus of claim 1 wherein the swivel axis member, the central region of the U-shaped clamp, the center cross-piece, and the end cross-piece extend substantially axially parallel to one another.

3. The apparatus of claim 1 wherein the load lifting element is attached to the central region of the U-shaped clamp.

4. The apparatus of claim 1 wherein the load lifting element is supported flexibly on the U-shaped clamp.

5. The apparatus of claim 1 wherein the first side leg of the clamping element is longer than the second side leg of the clamping element.

6. The apparatus of claim 5 wherein the end cross-piece has a free end which is arranged opposite to the second end of the second side leg and is spaced at a distance from the second end of said second side leg.

7. The apparatus of claim 6 wherein the free end of the end cross-piece includes an extension oriented towards the second end of said second leg.

8. The apparatus of claim 7 wherein the second end of the second side leg projects above the point at which the second side leg is joined to the center cross-piece and towards the free end of the end cross-piece.

9. The apparatus of claim 1 further comprising a safety element disposed in one of the bearings which supports the swivel axis member to prevent axial movement of the swivel axis member beyond an acceptable tolerance range.

10. The apparatus of claim 1 wherein the width of the clamping element is less than the distance between the first and second legs of the U-shaped clamp.

11. The apparatus of claim 1 wherein the U-shaped clamp and the clamping element comprise forged elements.

* * * * *